US006511404B2

(12) United States Patent
Tu

(10) Patent No.: US 6,511,404 B2
(45) Date of Patent: Jan. 28, 2003

(54) EXERCISE MACHINE CAPABLE OF TRAINING AND SOOTHING MUSCLES

(76) Inventor: Hsueh-Ho Tu, No. 8, Lane 8, Te Wei Street, U Feng Hsian, Taichung Hsien (TW)

( * ) Notice: Subject to any disclaimer, the term of this patent is extended or adjusted under 35 U.S.C. 154(b) by 94 days.

(21) Appl. No.: 09/824,631

(22) Filed: Apr. 4, 2001

(65) Prior Publication Data

US 2002/0147075 A1 Oct. 10, 2002

(51) Int. Cl.[7] ..... A63B 21/00
(52) U.S. Cl. ..... 482/57; 482/51; 601/48
(58) Field of Search ..... 601/48, 53, 67–70, 601/23, 27–32, 21; 482/53, 57, 51, 52, 70, 148

(56) References Cited

U.S. PATENT DOCUMENTS 5,411,454 A * 5/1995 Chang ..... 482/53
5,569,166 A * 10/1996 Stone ..... 601/21
5,765,921 A * 6/1998 Chuang ..... 601/28

* cited by examiner

*Primary Examiner*—Glenn E. Richman
(74) *Attorney, Agent, or Firm*—Browdy and Neimark, P.L.L.C.

(57) ABSTRACT

An exercise machine comprises a base, a resistance device, a control device, and a massaging device. The massaging device is formed of a pulse generator, a power source, and a plurality of massaging portions. The pulse generator and the power source are disposed in and controlled by the control device. The pulse generator is intended to generate a low frequency electric pulse, which is transferred to the massaging portions to promote the blood circulation in muscles, thereby resulting in the relief of muscular pain.

11 Claims, 4 Drawing Sheets

EXERCISE MACHINE CAPABLE OF TRAINING AND SOOTHING MUSCLES

FIELD OF THE INVENTION

The present invention relates generally to an exercise machine, and more particularly to an exercise machine which is provided with means to soothe the muscles of an exerciser.

BACKGROUND OF THE INVENTION

In the initial stage of exercise, the energy needed for muscular contractions is provided by adenosine triphosphate (ATP) and phosphocreatine (PC). Thereafter, the energy needed for muscular contractions is provided by anaerobic respiration (decomposition) of glycogen, which results in accumulation of lactate in the muscle. The lactate accumulation is responsible for pain in muscle or even in joint.

SUMMARY OF THE INVENTION

The primary objective of the present invention is to provide an exercise machine with dual functions of training muscles and soothing muscles.

In keeping with the principle of the present invention, the foregoing objective of the present invention is attained by an exercise machine comprising a base, at least one resistance device, and a massaging device. The resistance device is used in training muscles of an exerciser. The massaging device is intended to provide the energy to bring about a soothing effect on muscles. The energy is transferred by a massaging portion to the muscles of an exerciser to work in such a way that the energy promotes the blood circulation which reduces the lactate accumulation in muscle or joint, thereby resulting in the relief of the post-exercise muscular pain.

DETAILED DESCRIPTION OF THE INVENTION

Figure 1:
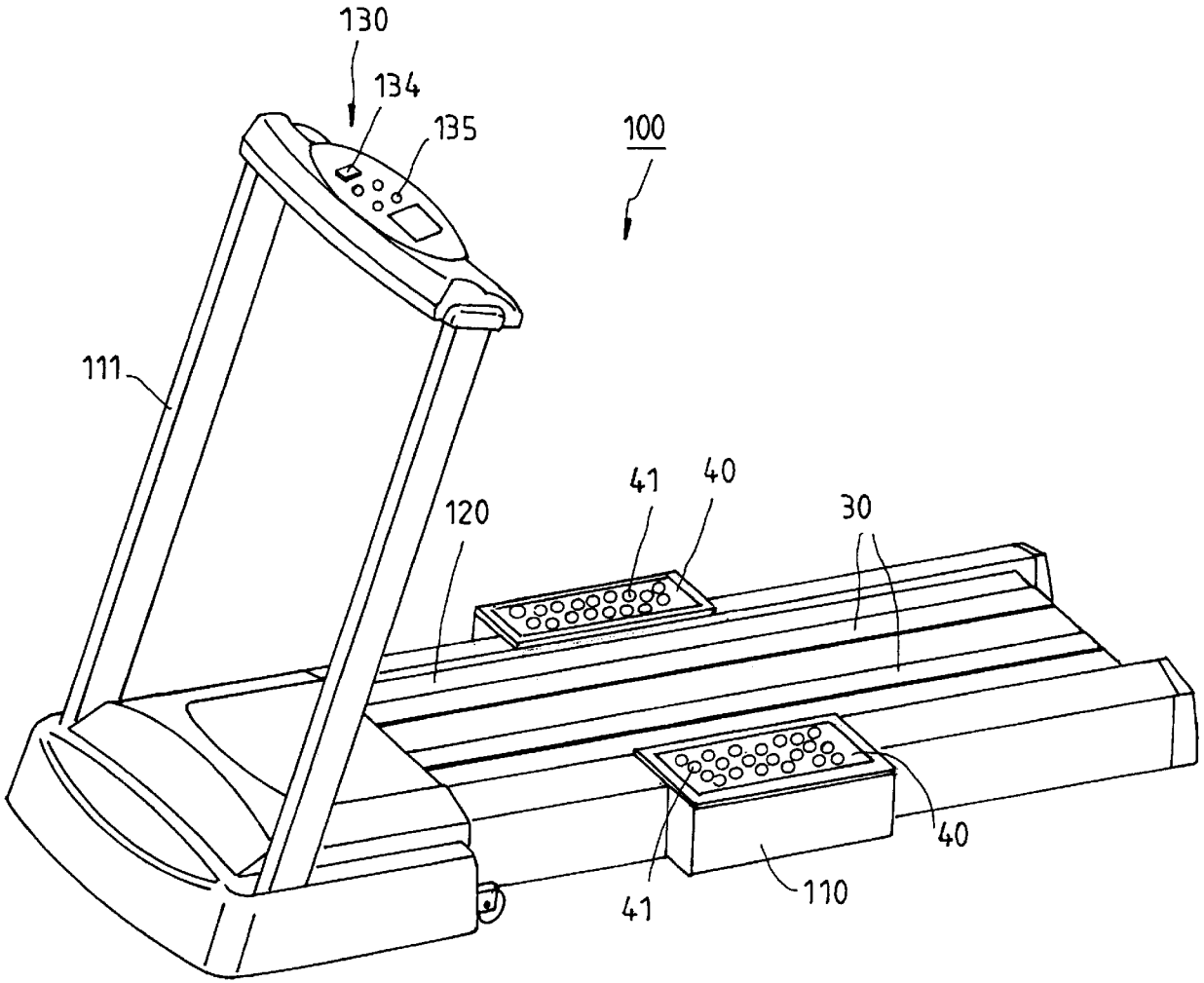
FIG. 1 shows a perspective view of a first preferred embodiment of the present invention.

As shown in FIG. 1, a jogging machine 100 of the first preferred embodiment of the present invention comprises a base 1 10, a resistance device 120 which is a track, a control device 130 mounted on handrails 111 of the base 110 for adjusting the magnitude of the resistance by adjusting the inclination of the track 120, and a massaging device which is not shown in the drawing. The massaging device comprises a pulse generator which is mounted in the control device 130 for generating a low frequency electric pulse, a power source mounted in the control device 130 to provide the pulse generator and the control device 130 with power. The operation of the pulse generator is controlled by an ON-OFF switch 134 and a plurality of control keys 135 of the control device 130. In other words, the magnitude and the form of the electric pulse generated by the pulse generator are regulated by the control keys 135. The jogging machine 100 further comprises two massaging portions 30 which are disposed on the track 120 such that they are parallel to each other, and that they are separated from each other by an appropriate interval. The massaging portions 30 are conductive tapes capable of transferring the low frequency electric pulse of the pulse generator to the soles of an exerciser. Two knobbed portions 40 are mounted on the base 110 such that they are opposite to each other, and that they are located in proximity of the two longitudinal sides of the track 120. The knobbed portions 40 are provided with a number of rounded protuberances 41 for stimulating the soles of the exerciser. The knobbed portions 40 are capable of receiving the low frequency electric pulse from the pulse generator. The electric pulse has a soothing effect on the muscle.

Figure 2:
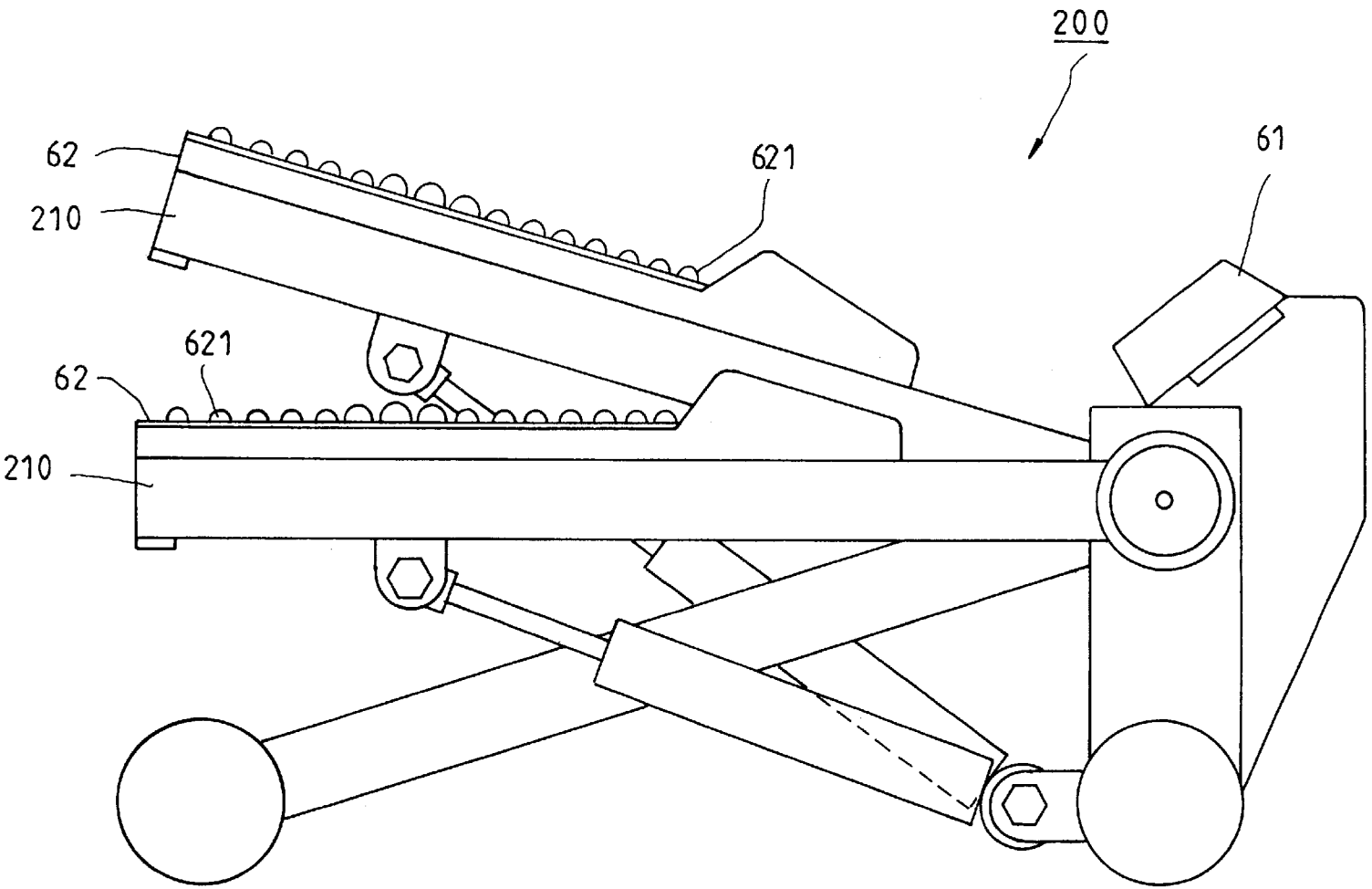
FIG. 2 shows a perspective view of a second preferred embodiment of the present invention.

As shown in FIG. 2, a walking machine 200 of the second preferred embodiment of the present invention comprises a pulse generator 61, two footboards 210, and two massaging portions 62 which are mounted respectively on the footboards 210. The pulse generator 61 is used to generate a low frequency electric pulse, which is transmitted to the massaging portions 62 to soothe the soles stepping on the massaging portions 62. The massaging portions 62 are provided with a number of knobs 621 for stimulating the soles.

Figure 3:
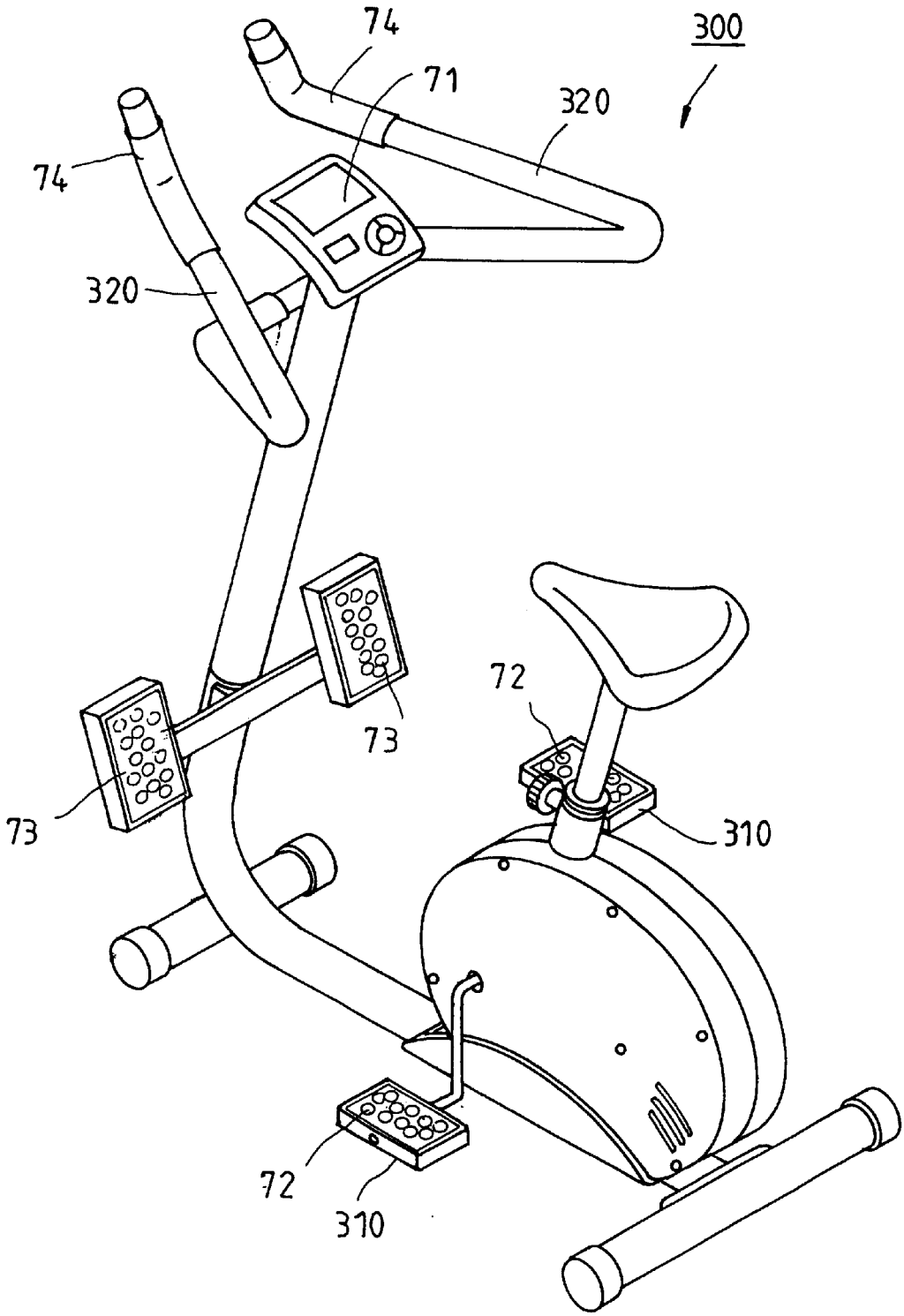
FIG. 3 shows a perspective view of a third preferred embodiment of the present invention.

As shown in FIG. 3, an exercise bike 300 of the third preferred embodiment of the present invention comprises a seat, two handlebars 320, two pedals 310, a control device 71 fastened with the handlebars 320, and a pulse generator disposed in the control device 71. The pedals 310 are provided with a knobbed portion 72. The bike 300 is provided with two knobbed portions 73 which are fastened with the bike frame such that they are located in front of the bike seat. The handlebars 320 are provided with two massaging portions 74. The pulse generator generates a low frequency electric pulse, which is transmitted to the knobbed portions 72, 73, and the massaging portions 74.

Figure 4:
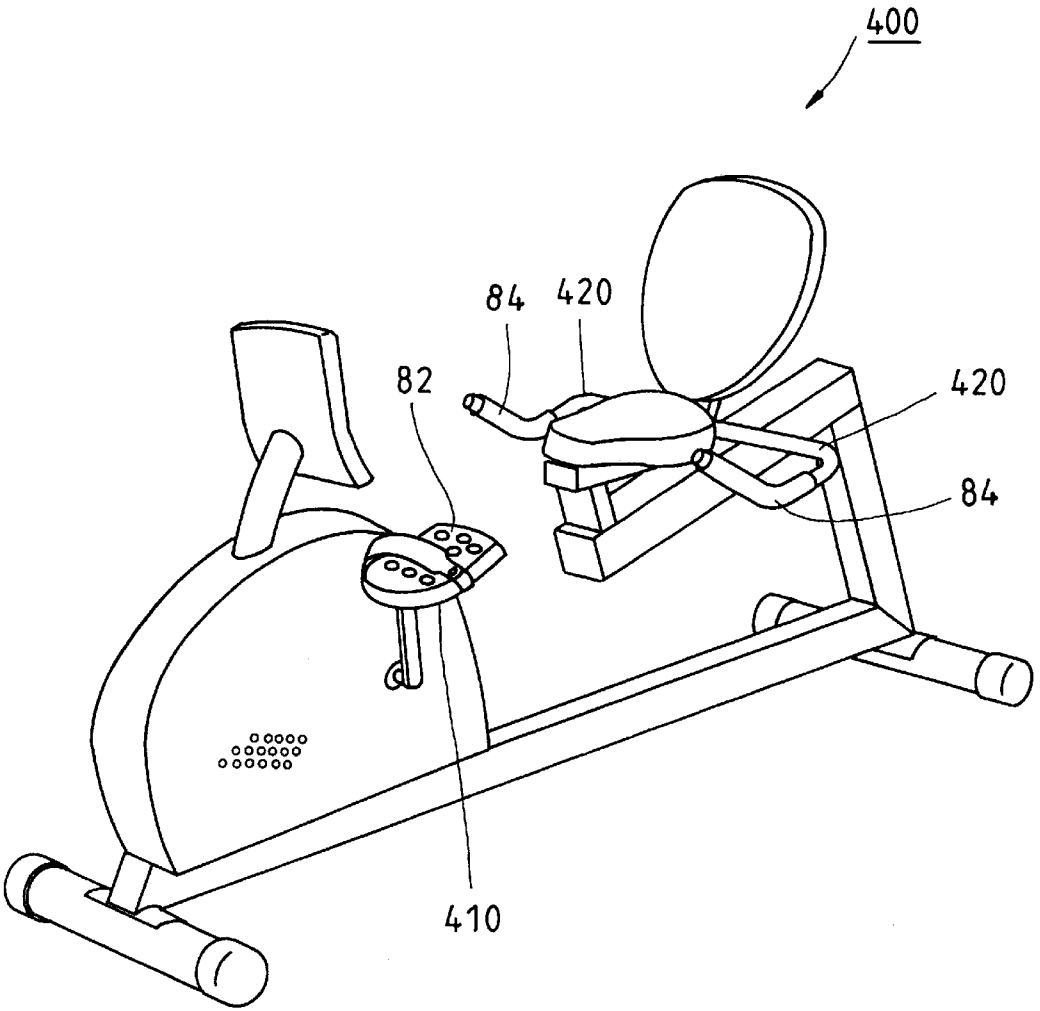
FIG. 4 shows a perspective view of a fourth preferred embodiment of the present invention.

As shown in FIG. 4, a relaxing machine 400 of the present invention comprises a seat, two resistance devices 410, and two handlebars 420. The resistance devices 410 are two pedals which are provided with a knobbed portion 82. The two handlebars 420 are provided with a massaging portion 84. The relaxing machine 400 further comprises a control device (not shown in the drawing) in which a pulse generator is disposed. The pulse generator generates a low frequency electric pulse, which is transmitted to the knobbed portions 82 and the massaging portions 84.

The embodiments of the present invention described above are to be regarded in all respects as being merely illustrative and not restrictive. Accordingly, the present invention may be embodied in other specific forms without deviating from the spirit thereof. For example, the present invention may comprise a vibration device in place of the massaging device. The present invention is therefore to be limited only by the scopes of the following appended claims.

What is claimed is:

1. An exercise machine comprising:

a base;

a resistance device mounted on said base to bring about an exercise effect;

a control device mounted on said base and provided with an ON-OFF switch and a plurality of control keys; and a massaging device comprising a pulse generator and a power source, which are disposed in said control device and are regulated by said switch and said control keys of said control device, said pulse generator intended to generate a low frequency electric pulse, said massaging device further comprising a plurality of massaging portions whereby said low frequency electric pulse is transmitted to said massaging portions.

2. A jogging machine comprising:

a base;

a track mounted on the upper surface of said base for providing a resistance;

an upright frame mounted at one end of said base;

a control device mounted on the top of said upright frame and provided with an ON-OFF switch and a plurality of control keys; and a massaging device comprising a pulse generator, a power source, and a plurality of massaging portions, with said pulse generator and said power source being disposed in and controlled by said control device, and with said massaging portions being disposed in proximity of said track such that said massaging portions receive a low frequency electric pulse generated by said pulse generator.

3. The jogging machine as defined in claim 2, wherein said massaging portions are two conductive tapes which are disposed on the upper surface of said base such that said two conductive tapes extend along the two longitudinal side edges of said track, and that said two conductive tapes receive said low frequency electric pulse.

4. The jogging machine as defined in claim 2, wherein said massaging portions are two footboards which are fastened to the upper surfaces of two longitudinal sides of said base and are provided with a knobbed upper surface for stimulating the sole of an exerciser whereby said two footboards receive said low frequency electric pulse.

5. A walking machine comprising:

a base;

two footboards pivoted to said base;

a control device mounted on said base and provided with an ON-OFF switch and a plurality of control keys; and a massaging device comprising a pulse generator, a power source, and a plurality of massaging portions, with said pulse generator and said power source being disposed in and controlled by said control device, and with said massaging portions being disposed on an upper surface of said two footboards such that said massaging portions receive a low frequency electric pulse generated by said pulse generator.

6. The walking machine as defined in claim 5, wherein the upper surface of said footboards is knobbed.

7. An exercise bike comprising:

a base;

a seat mounted on said base;

two pedals pivoted to said base;

two handlebars mounted uprightly on said base;

a control device supported by said two handlebars and provided with an ON-OFF switch and a plurality of control keys; and a massaging device comprising a pulse generator, a power source, and a plurality of massaging portions, with said pulse generator and said power source being disposed in and controlled by said control device, and with said massaging portions being disposed on said handlebars and said pedals such that said massaging portions receive a low frequency electric pulse generated by said pulse generator.

8. The exercise bike as defined in claim 7, wherein said massaging portions of said pedals are knobbed.

9. A relaxing machine comprising:

a base;

a seat mounted on said base;

two pedals pivoted to said base;

two handlebars pivoted to said base;

a control device mounted on said base and provided with an ON-OFF switch and a plurality of control keys; and a massaging device comprising a pulse generator, a power source, and a plurality of massaging portions, with said pulse generator and said power source being disposed in and controlled by said control device, and with said massaging portions being disposed on said pedals and said handlebars such that said massaging portions receive a low frequency electric pulse generated by said pulse generator.

10. The relaxing machine as defined in claim 9, wherein said massaging portions of said pedals are provided with a plurality of knobs.

11. The exercise machine as defined in claim 1, wherein said massaging device is a vibration machine.

* * * * *